United States Patent [19]

Dunlop

[11] 4,079,773

[45] Mar. 21, 1978

[54] METHOD OF MANUFACTURING SHELL CORES AND MOLDS USING A GASSING CANOPY

[75] Inventor: Andrew P. Dunlop, Riverside, Ill.

[73] Assignee: The Quaker Oats Company, Chicago, Ill.

[21] Appl. No.: 754,359

[22] Filed: Dec. 27, 1976

[51] Int. Cl.[2] ..... B22C 9/12

[52] U.S. Cl. ..... 164/16; 164/410

[58] Field of Search ..... 164/12, 16, 13, 45, 164/410; 425/175; 264/219, 225, 226

[56] References Cited

U.S. PATENT DOCUMENTS

| | | | |
|---|---|---|---|
| 3,145,438 | 8/1964 | Kottke et al. | 164/16 |
| 3,795,726 | 3/1974 | Zifferer et al. | 164/12 X |
| 3,888,293 | 6/1975 | Laforet et al. | 164/16 |

FOREIGN PATENT DOCUMENTS

| | | | |
|---|---|---|---|
| 2,232,376 | 1/1975 | France | 164/16 |

*Primary Examiner*—Francis S. Husar
*Assistant Examiner*—Mark Rosenbaum
*Attorney, Agent, or Firm*—Joseph P. O'Halloran

[57] ABSTRACT

A "cold box" process is disclosed in which a "green strength" sand binder mass is removed from a pattern, and placed under a canopy for gassing. The binder-curing gas catalyst is then introduced into the void space between the sand mass and the canopy until it penetrates the exposed surfaces of the sand-binder mass effecting a cure. Control of depth of penetration of the gas catalyst, and therefore, control of the thickness of the shell cured, is achieved by control of pre- and post-gassing pressures. The residual pre-gassing interstitial inert gas (usually air) is utilized as the internal "cushion" which limits the penetration of the advancing catalyst gas.

16 Claims, 17 Drawing Figures

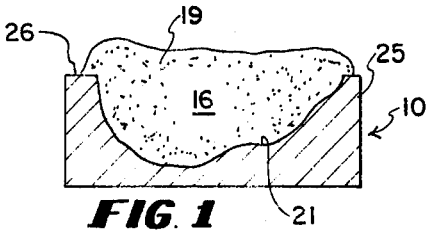
FIG. 1
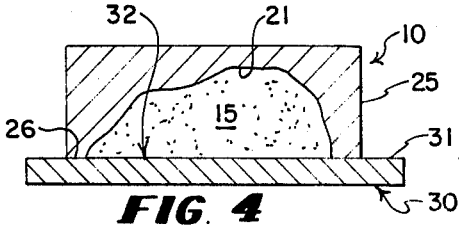
FIG. 4
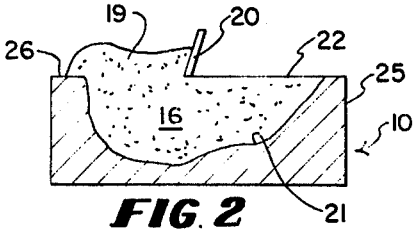
FIG. 2
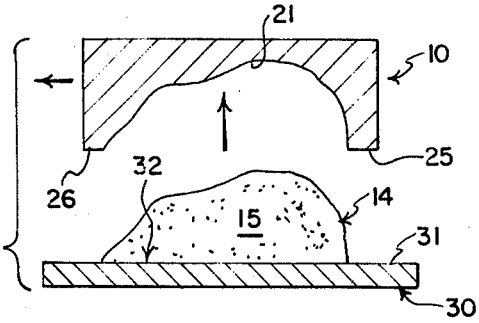
FIG. 5
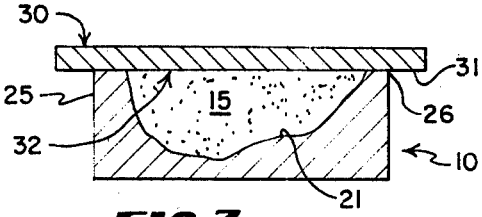
FIG. 3
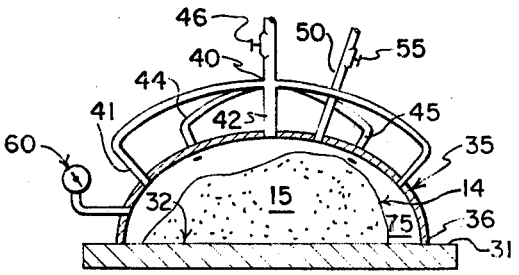
FIG. 6
FIG. 7
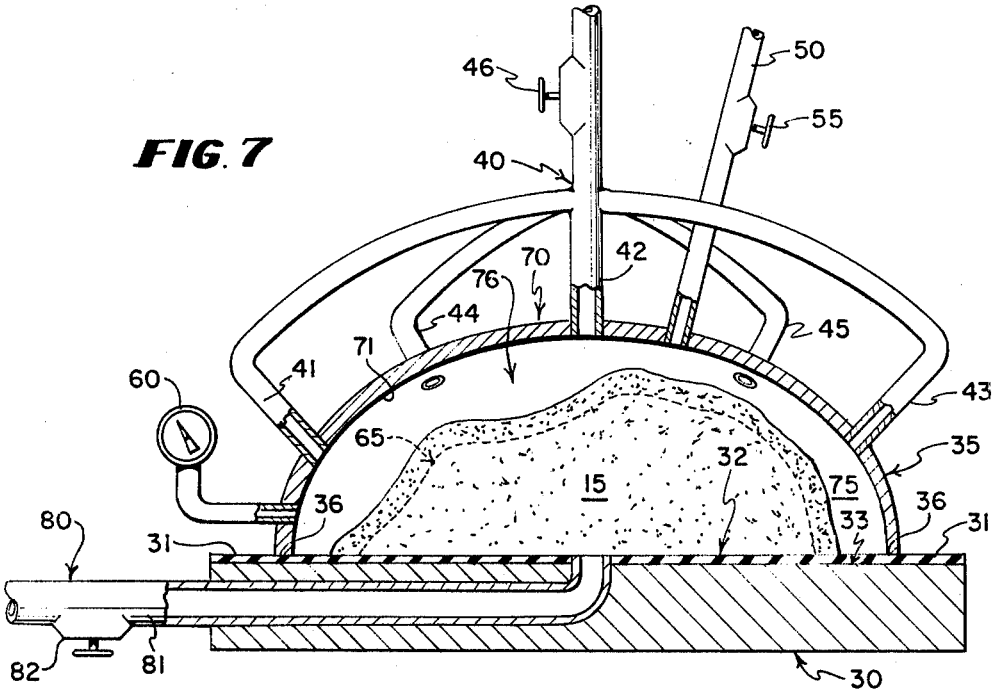

FIG. 8
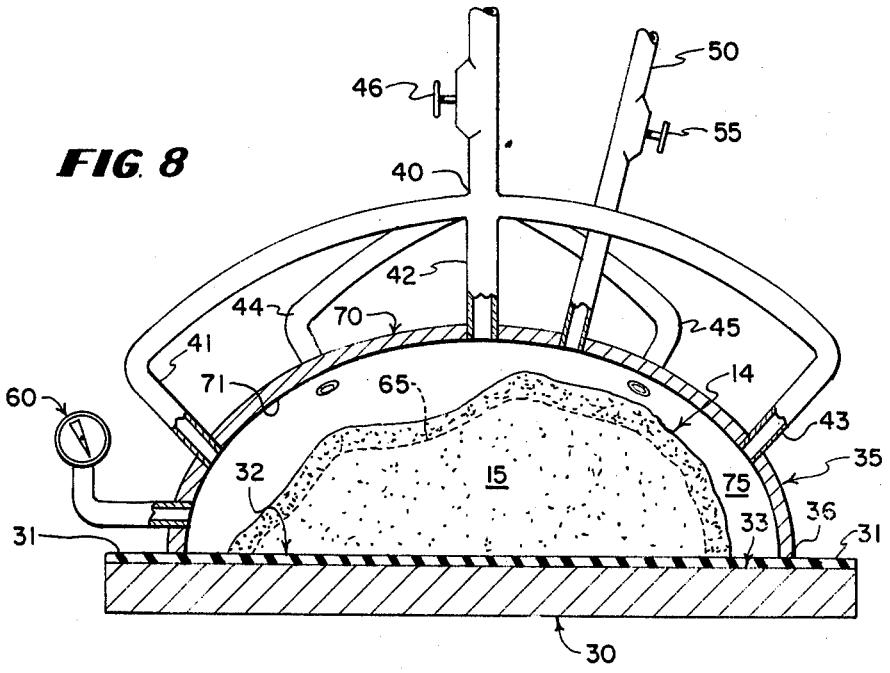
FIG. 9
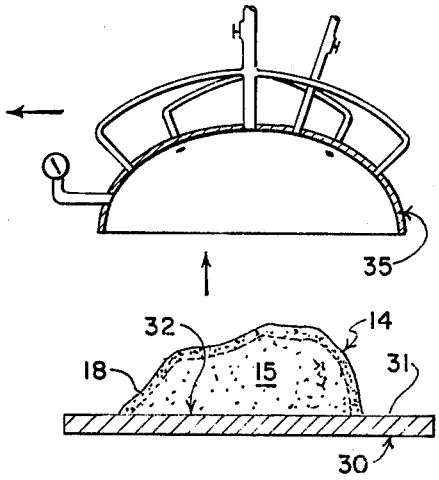
FIG. 10
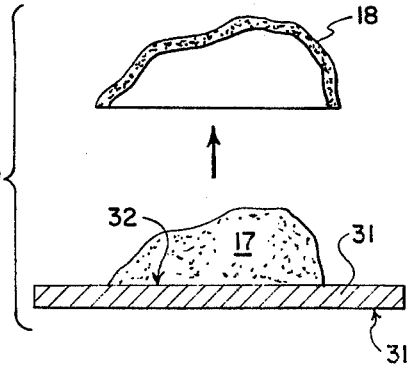
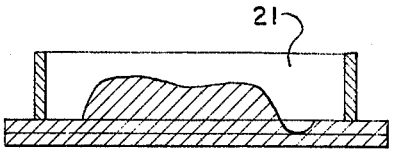
FIG. 12
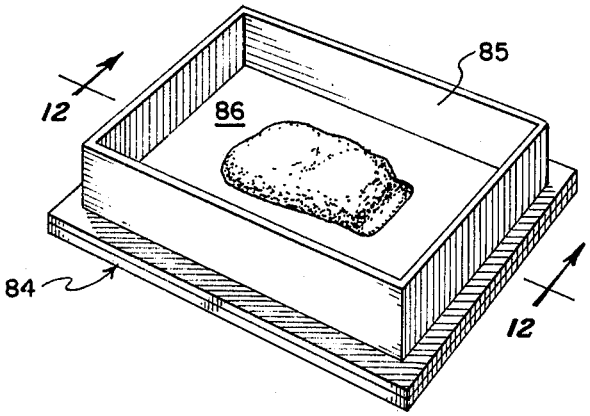
FIG. 11

METHOD OF MANUFACTURING SHELL CORES AND MOLDS USING A GASSING CANOPY

BACKGROUND OF THE INVENTION

The production methods for shell cores and molds which were commonly used heretofore have had various economic, and physical disadvantages. However, the use of "shell" concept is advantageous because of the reduced amount of sand-binder needed.

The Kroning process, which is one of the earliest known dry "hot box" methods, is feasible for use in the production of relatively small shell cores and molds. It requires heated patterns which must be able to compensate for thermal warpage and expansion, and for the abrasion caused by the placement of sand therein. For this reason, they are usually made for iron or steel. This process involves the use of sand having coated thereon a dry solid resin, usually a phenol-formaldehyde novolac resin, catalyzed with hexamethylene tetramine. This catalyzed resin binder is stable under ordinary atmospheric ambient conditions but is catalytically polymerized, that is, cured at elevated temperatures. In the practice of the Kroning method, the dry coated catalyzed sand, usually AFS 80–90 grain fineness, for example, is packed into a metal pattern capable of being heated. The pattern is pre-heated to a sufficiently high temperature, e.g. 450°–500° F. to achieve the polymerization of the binder on the sand disposed thereagainst. Typically only a thin layer of the sand mixture is cured and the pattern is then inverted and the uncured sand-binder is dumped and separated from the relatively thin "shell" of cured sand-binder, and the dumped uncured sand-binder portion is salvaged for reuse.

In the so-called "cold box" method for the manufacture of shell cores and molds liquid or "wet" binders such as, for example, liquid furfuryl alcohol resin binders are used. These cold box methods require manual placement of a thin layer of the sand-binder mixture against the pattern. The use of vibrators to increase interparticulate contact requires care insofar as substantially vertical portions of the packed sand may tend to dislodge or separate. Usually, these patterns are provided with venting means for passing the catalyst gas through the entire sand mass thus curing all of the sand-binder mix therein. This method also suffers the disadvantage of requiring hand packing or hand placement of the initially used sand-binder mixture resulting in inconsistent and non-uniform sand depth dimensions, and therefore, in non-uniform shells.

Illustrative of patents which have related to these areas include U.S. Pat. No. 3,008,205 to H. O. Blaies, Jr., "Shell Type Molds and Cores", U.S. Pat. No. 2,874,428 to J. V. L. Bonney, Jr., "Method of Hardening of Shell Cores and the Like", U.S. Pat. No. 3,145,438 to R. H. Kottke, et al., "Gas Cure of Organic Bonds for Sand and Abrasive Granules", U.S. Pat. No. 3,428,110 to J. Walker, et al., "Process for Production of Foundry Cores and Molds", and U.S. Pat. No. 3,639,654 to J. Robins, for "Gaseous Halo-Sulfonic Acid Anhydride Catalysts for Curing Furfuryl Alcohol and Furan Resin".

It is an object of the present invention to provide a "cold box" method for making shell cores and molds, which method does not require the manual placement of a relatively thin layer of sand-binder mixture for complete curing thereof, and which method also provides automatically for the curing of the sand-binder mixture which is exposed to the catalytic gasses in the void space within the gassing canopy wall.

SUMMARY OF THE INVENTION

This invention utilizes the so-called "green strength" capability of the uncured sand-binder mixture to maintain its shape after it is removed from a pattern. Also, control of the pre- and post-gassing pressures is used to control the depth of penetration of the gas catalyst into the shaped sand mass, thus allowing hardening or curing of only that portion of the shaped sand mass which is exposed to the void space between the canopy and the sand mass itself. By controlling the pressure ratios, the volume of residual interstitial inert gas trapped within the sand mass is controlled, and thus the penetration of gas catalyst into the sand shaped mass is limited.

While we do not want to be bound by any particular theories, it is our belief, based on repeated observation, that the inert gas (usually air) which initially resides in the canopy void space and in the interstitial space between the sand particles serves as a "cushion" or barrier which prevents the rapid passage of the gas catalyst into the sand mass beyond the pre-determined extent.

Referring to the drawings (FIGS. 1–17):

FIGS. 1–6 are schematic elevational cross-sectional views of the sand molding apparatus in various configurations in accordance with the present invention.

FIG. 7 is an enlarged partially cross-sectional elevational view of the apparatus (during the gassing stage of the method of the present invention) which is used when the post-gassing pressure is sub-atmospheric, atmospheric, or super-atmospheric.

FIG. 8 is an enlarged partially cross-sectional elevational view of the apparatus (also during the gassing stage of the method of the present invention) when the post-gassing pressure is atmospheric or super-atmospheric.

FIGS. 9–10 are schematic elevational cross-sectional views of the sand molding apparatus in various configurations in accordance with the present invention.

FIG. 11 is a perspective view of conventional sand molding apparatus which can be used in accordance with the present invention.

FIGS. 12–15 are schematic elevational cross-sectional views taken along the line 12—12 of FIG. 11 in various configurations at various stages of the method of the present invention.

DETAILED DESCRIPTION OF THE DRAWINGS

Figure 13:
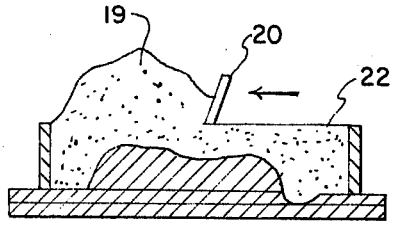
Figure 14:
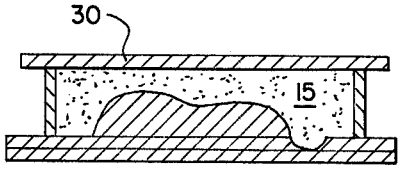

FIG. 1 illustrates the charging of a mass 16 of sand-binder mixture into the body portion 21 of a pattern 10 with an excess quantity 19 of sand being allowed to extend above the upper edge 26 of the pattern wall 25.

FIG. 2 shows a screed 20 (conventional in foundry practice) being drawn from one upper edge 26 of the pattern wall 25, across the charged sand-binder mixture 16, to the opposite pattern wall 25. This gives a planar surface 22 of sand-binder mixture even with the upper edges 26 of the pattern 10, resulting in a shaped sand mass 15.

FIG. 3 shows a rigid flat pallet 30 being placed over the top of the shaped sand mass 15 and pattern 10. This rigid, flat pallet 30 has greater dimensions than the pattern 10 it is resting on, and therefore extends radially beyond the walls 25, 25 of the pattern 10, thus providing marginal portion 31.

FIG. 4 shows the pattern 10 and the shaped sand mass 15 and pallet 30 being inverted so that the pattern 10 and the shaped sand mass 15 rest upon the rigid pallet 30.

FIG. 5 illustrates the careful removal of the pattern 10 from the shaped sand mass 15 and the pallet 30.

FIG. 6 shows the placement of the gassing canopy 35 over the shaped sand mass 15 with the canopy bottom 36 resting on the marginal portion 31 of the rigid flat pallet 30.

In the embodiment shown in FIG. 7 the gassing canopy 35 is equipped with catalyst-gassing means 40 which has a plurality of conduits 41, 42, 43, 44 and 45, which pass through the canopy wall 70 at various locations. The catalyst-gassing means 40 is controlled by valve 46. The gassing canopy 35 is also equipped with a vacuum means 50, equipped with valve 55, and pressure reading means 60. This pressure reading means 60 communicates with the void space 75 which is created by the gap between the inner canopy wall 71 and the surface 14 of the shaped sand mass 15. The bottom edge 36 of the gassing canopy 35 rests upon the thin flexible layer 32 which adheres to the top surface 33 of the rigid pallet 30, thus sealing the enclosed region 76 from the atmosphere. An inert atmosphere, usually air, is provided at a pre-gassing pressure of $P_1$. Generally speaking, the $P_1$ can be below, at or above the atmospheric pressure. Upon introduction of the catalyst gas, the gas pressure in the region 76 is increased to a post-gassing pressure $P_2$. By controlling the pressure ratios, the volume of residual interstitial inert gas trapped within the shaped sand mass 15 is controlled, thus limiting the penetration of the gas catalyst into the shaped sand mass 15, (as illustrated by the dashed line 65), and therefore, controlling the thickness of the cured shell. When the shell is cured, the canopy pressure is adjusted to atmospheric pressure, if necessary.

When adjustment of the gas pressure of the gas within the space 76 to atmospheric pressure requires an increase with respect to post-gassing pressure $P_2$, the adjustment must be made by introducing gas through the interstitial spaces in sand mass 15. However when the adjustment of gas pressure of the gas within the space 76 to atmospheric pressure requires a decrease with respect to post-gassing pressure $P_2$, the adjustment must be made by venting gas directly from the void space 75, e.g. through canopy 35. When post-gassing pressure is atmospheric pressure, a further adjustment before canopy 35 is removed, is unnecessary. Generally speaking, post-gassing pressure $P_2$ is that pressure prevailing whenever the gas catalyst has penetrated sand mass 15 to the deepest extent.

FIG. 8 shows the details of the assembly used when the post-gassing pressure $P_2$ is atmospheric or super-atmospheric. The details of the gassing canopy 35 which are identical to those in FIG. 7, have the numbering which is identical.

FIG. 9 illustrates the removal of the canopy after the gas catalyst curing of the shell 18 or outer portion of the sand shape.

FIG. 10 illustrates the removal of the sand cured shell 18 from the uncured binder sand 17 on the rigid flat pallet 30.

FIGS. 11–17 are intended to illustrate the practice of the present invention in those embodiments in which the shaped sand mass 15 is confined within a flask 85 during the gassing operation.

In FIG. 11 a conventional pattern-flask assembly is indicated generally by the numeral 84. The assembly 84 consists of a flask 85 and pattern 86. The flask 85 constitutes side walls of a body portion 21 into which a surplus of sand is conventionally charged and, typically, rammed to assure intimate and exact conformation to the pattern 84. In the description of this particular embodiment, many of the components referred to obviously correspond to components which were described in connection with the previously mentioned embodiments. The numerals which are used to identify such components are identical to the numerals which have been used hereinbefore to identify the corresponding to equivalent components.

Figure 15:
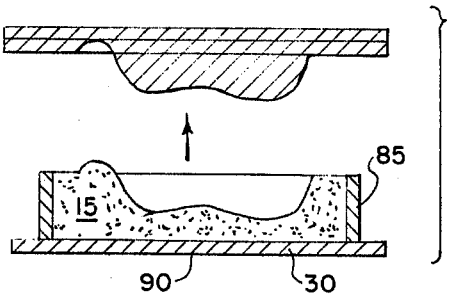

Thus, as illustrated in FIG. 13 an excess 19 of the sand-binder mixture is scraped from the pattern-flask assembly 84 by drawing a screed 20 along the top of the flask 85, a pallet 30 is placed on the top of the flask, and the flask-assembly 84 — pallet 30 combination is inverted so that the flask-pallet assembly 84 rests on pallet 30, as illustrated in FIG. 15. The pattern 86 is carefully lifted, and the shaped sand mass 15 remains within flask 85, residing on pallet 30, to provide shaped sand assembly 90.

Figure 17:
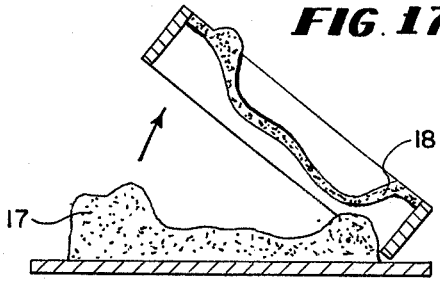
FIG. 17 is an elevational cross-sectional view of the apparatus shown in FIGS. 11–15 with portions thereof in a moved configuration.
Figure 16:
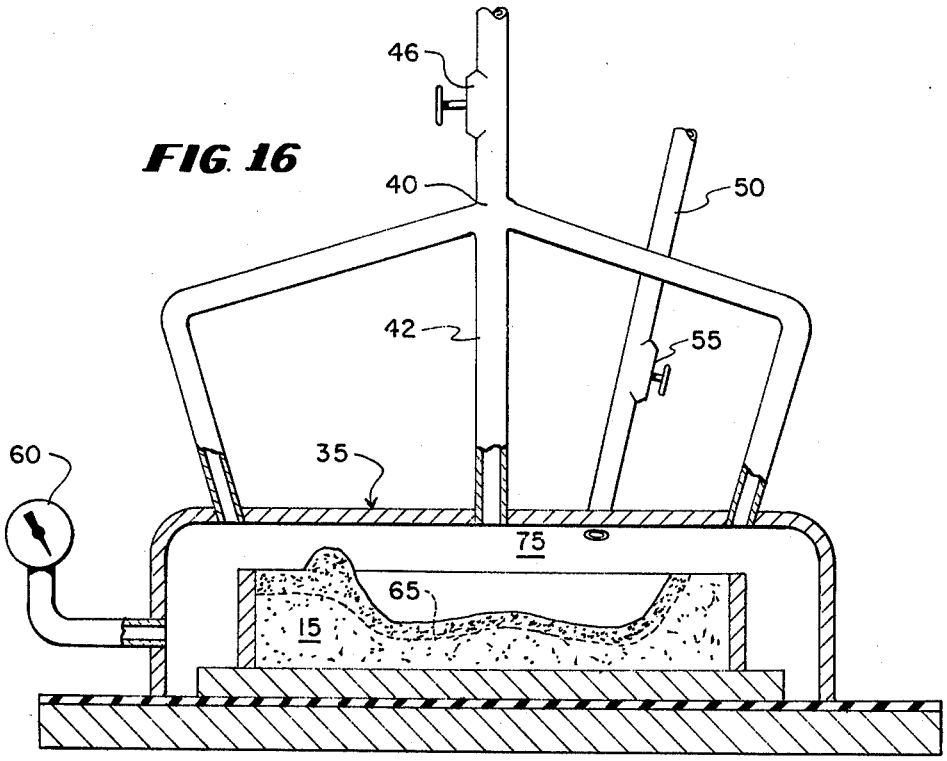
FIG. 16 is an enlarged partially cross-sectional elevational view of the apparatus shown in FIGS. 11–15 (during the gassing stages of the method of the present invention) which is used when the post-gassing pressure is atmospheric or super-atmospheric.

The shaped sand assembly is placed within a canopy 35, and the pressure within the void space 75, for example, is reduced to $P_1$, e.g. 300 mm Hg. and the gaseous catalyst introduced by way of catalyst conduit means 40 into void space 75 to secure penetration in the manner hereinbefore described to a limited extent to the region delineated by the dashed line identified by the numeral 65 in FIG. 16. Gas catalyst is introduced until the pressure within the canopy 35 reaches atmospheric pressure, and the canopy is removed, the assembly 90 withdrawn, and, as illustrated in FIG. 17, the hardened shell 18 is removed from the remaining uncured binder 17.

PRACTICE OF THE INVENTION

This invention is further illustrated by the following Examples in which all of the amounts of ingredients are expressed in parts by weight unless otherwise indicated. All temperatures are expressed in degrees centigrade, and all percentages are expressed in percent by weight of the component referred to based on the weight of the overall mixture referred to, unless otherwise indicated.

The first Example is intended to illustrate the typical mode of operation in accordance with the present invention when a relatively noxious catalyst and a sub-atmospheric post-gassing pressure are employed. The second Example is intended to illustrate a typical mode of operation when a non-noxious catalyst and atmospheric post-gassing pressure are used. Example 3 illustrates the mode of operation when the post-gassing pressure is super-atmospheric. In all instances, however, it will be appreciated that the thickness of the shell can be increased or decreased by increasing or decreasing, respectively, the pressure differential before and after gassing.

EXAMPLE 1

The equipment described heretofore in FIG. 7 is used. Foundry sand having AFS fineness number in the range of 80–90 is coated with 0.7 percent of a commercially available liquid resin identified as Farea 42, uniformly distributed on the sand. This resin is reported to comprise 42 percent furfuryl alcohol monomer, 58 percent by weight of a "UF-85" which is an equilibrium mixture of 60 parts of formaldehyde, 25 parts of urea, and 15 parts of water. Farea 42 is reported to have about 9 percent water. A mass of this sand mixture 16 is charged to the body portion 21 of pattern 10, and the steps described above are carried out. Once the gassing canopy 35 is in place, catalyst gassing valve 46 is closed, the valve 55 for the vent vacuum means 50 is opened, a vacuum is drawn, and the pressure within the gassing canopy 35 is reduced to a pre-determined level, e.g. 100 mm Hg. The edges 36 of the gassing canopy 35 resting on the rigid pallet 30 are pressed even more firmly onto the thin flexible layer 32 of the top surface of the pallet 33 enhancing the gas tight seal between the atmosphere and the enclosed region 76.

When pressure reading means 60 indicates that the pre-determined $P_1$ pressure has been reached, the vacuum valve 55 is then closed, and valve 46 to the catalyst-gassing means 40 is opened, thereby introducing gaseous hydrogen chloride into the void space 75 through conduits 41, 42, 43, 44 and 45. Residual air within the void space 75 and within the interstitial spaces in the packed sand mass 15, begins "retreating" before the advancing catalyst gas front. This retreat of the inert gas into the sand mass 15 causes an internal "cushion" which limits penetration of the advancing catalyst gas, and therefore, limits the curing to only a thin shell of exposed sand binder. An illustrative depth of penetration in curing is indicated by the dash line 65, within the sand mass 15 in FIG. 7.

When pressure reading means 60 indicates that the pressure, $P_2$, has reached the pre-determined level, e.g. 700 mm Hg., the valve 46 to the gas catalyst-gassing means 40 is closed off. Valve 82 on conduit 81 of the pallet vent means 80 is opened to permit gas pressure within the canopy 35 to reach atmospheric by introducing air through the inert gas "cushion" of the shaped sand mass 15. When sub-atmospheric post-gassing pressures are used, it is important that this pressure is equalized from within the shaped sand mass 15 in order to arrest the further penetration of the catalyst gas into the sand mass when the pressure within the void space 75 increases to atmospheric pressure. It is noted that a liquid binder containing substantial levels of water serves as an extremely efficient scrubber of gaseous HCl, for example, and the resin is substantially instantaneously cured. Valve 55 is then opened to allow the gaseous HCl to be flushed out of the system permitting the atmospheric air to pass through the interstitial gas spaces within the packed sand mass 15 and the void space 75. Typically a conventional acid scrubber (not shown) is provided between the gas canopy 35 and the pressure reducing means (not shown). Valve 55 is then closed, and the canopy 35 is lifted off of the rigid pallet 30. The cured binder shell 18 is then lifted from the surface of the uncured binder sand 17. Thus, the uncured binder sand mixture 17 which is left upon the rigid pallet 30 can be salvaged.

EXAMPLE 2

In this Example, the equipment illustrated in FIG. 8 can be used. The procedure described herein is preferred for a non-noxious catalyst gas with the post-gassing pressure at atmospheric pressure, e.g. 760 mm Hg. Also, because the post-gassing pressure is atmospheric or above, the pallet 30 does not require vent means 80 entering into the shaped sand mass 15.

Foundry sand having 80–90 AFS fineness number is coated with sodium silicate solution (aqueous) of the type described in detail in U.S. Pat. No. 2,874,428 to John L. V. Bonney, Jr., and the resulting sand-binder mixture is charged 16 to the body portion 21 of the pattern 10 as described in Example 1, and the steps described in connection with the description of the figures are repeated.

However, when the gassing canopy 35 is in place, the valve 55 for the vent vacuum means 50 is opened, and the vacuum drawn, and the pressure within the gassing canopy 35 is reduced to a pre-determined level, $P_1$, e.g. 400 mm Hg. Again, the gassing canopy 35 and the rigid pallet 30 give a gas-tight seal between the atmosphere and the enclosed region 76. As in Example 1, an internal "cushion" is provided within the shaped sand mass 15 when the valve 46 to the catalyst-gassing means 40 is opened and the catalyst gas, gaseous carbon dioxide, is introduced to the void space 75 through conduits 41, 42, 43, 44 and 45. The residual inert gas in the void space 75 and within the interstitial gas spaces in the sand-binder mass 15 retreats to form the internal "cushion" as the carbon dioxide catalyst advances. Again, it is the control of the pressure ratios which determines the depth of penetration of the catalyst gas and therefore the thickness of the cured shell. This depth of penetration is again indicated in FIG. 8 by the dashed line 65. When pressure reading means 60 indicates that the pressure within the gassing canopy 35 has reached atmospheric pressure, $P_2$ the valve 46 to the catalyst-gassing means 40 is closed off.

Now the canopy 35 is lifted, and the cured shell 18 is separated from the uncured sand-binder mixture 17. The uncured sand-binder mixture 17 will be salvaged to again be charged into the pattern 10 and reused. It is important to note that if the gas in the gassing canopy does contain a substantial level of carbon dioxide prior to the introduction of the gas catalyst, it may be necessary to adjust the pressure differential (post-gassing pressure minus pre-gassing pressure) to compensate for any early entry of the carbon dioxide into the interstitial spaces. Generally speaking, of course, the pressure differential employed is substantially less when the initial gas within the void space 75 contains a substantial level of the gas catalyst.

EXAMPLE 3

In this Example, the equipment illustrated in FIG. 8 is used. The procedure described is the same as that used in Example 2. However, the pre-gassing pressure is atmospheric, and the post-gassing pressure in this Example is super-atmospheric, e.g. 800 mm Hg. Again, the gas catalyst used is carbon dioxide. When using post-gassing pressures which are super-atmospheric, it is necessary that the equalization of the pressure occur by way of directly venting the void space 75. Therefore, in this Example, when the post-gassing pressure reaches the required level, 800 mm Hg., the catalyst gassing means valve 46 is turned off, and the vacuum-vent means valve 55 is opened to allow the pressure within the void space 75 to be reduced to atmospheric pressure, e.g. 760 mm Hg. This reduction of pressure to atmospheric does not effect a greater penetration of the gas catalyst, and therefore does not affect the thickness of the cured shell 18.

This invention is not limited to the use of any particular binder or to any particular gassing catalyst and it is contemplated that it is applicable with any binder system which is readily curable by any respective catalyst gas. For example, the method can employ the well known amino-isocure catalyst binder systems, as well as other systems. Also, in the Examples referred to above, substantially pure gas catalyst was referred to and, in fact, either pure gas catalyst can be used or a gaseous mixture containing a catalyst, e.g. with an air catalyst mixture, can be used for a more moderate modified curing rate.

Generally speaking, it is preferred that the sizes of the gas canopy 35, and the pattern means 10 be such that the void space 75 is as small as is practical, taking into consideration the need for the canopy to clear the sand mass 15 by a large enough margin to allow for slight variations in its placement upon the rigid pallet 30.

It is apparent that the depth of penetration of the gas catalyst is controlled by the pre- and post-catalyst gassing pressure differential. The greater the depth of penetration of gas catalyst desired, the greater pressure differential used. For example, in one embodiment of the present invention, the initial vacuum may be pulled to 100–200 mm Hg. and during the catalysis the gas pressure may be permitted to raise to 500 mm Hg. If greater penetration is desired, an equilibrium post-gassing pressure closer to 760 or super-atmospheric may be utilized.

In the event a sub-atmospheric, e.g. 500 mm Hg., post-gassing pressure is utilized the pressure within the internal "cushion" of shaped sand mass 15 must be increased to atmospheric pressure to prohibit the catalyst gas from penetrating further into the shaped sand mass 15 when the gassing canopy 35 is removed and the pressure within the void space 75 increases. When the post-gassing pressure is atmospheric or super-atmospheric the pressure is equalized by way of the void space 75 with no further penetration of the catalyst gas effected.

Also, the operation of this invention is not limited to the use of sub-atmospheric pressure ratios. The pressures can be sub-atmospheric or atmospheric or super-atmospheric pressures as desired. At the heart of this invention is the utilization of the residual pre-gassing inert gas as the internal cushion which limits the penetration of the advancing gas catalyst into the sand shape.

I claim:

1. The method of manufacturing shell cores and molds comprising:

a. positioning an uncured shape sand mass within a gassing chamber to provide a void space between said shaped sand mass and walls of said chamber, and sealing said chamber with respect to communication of the gas in said chamber with the atmosphere, said shaped sand mass resting on a gas-impervious surface, said shaped sand mass having a shaped surface directly exposed to said void space, said sand mass comprising sand having a uniform coating of binder dispersed thereon, said binder comprising a gas curable binder;

b. providing an initial pressure $P_1$ of an inert gas atmosphere within said chamber;

c. introducing a gaseous catalyst into said chamber by way of said void space until a post-gassing pressure $P_2$ is achieved; the difference between $P_1$ and $P_2$ being such that the extent of penetration of the catalyst into the charged sand mass is limited, to provide a cured sand shell at the shaped surface of desired thickness, with the internal portions of the shaped uncured mass remaining;

d. whenever said post-gassing is above or below atmospheric pressure providing an adjustment of the pressure within said chamber, said adjustment comprising introducing an inert gas into said sand mass whenever said $P_2$ is below atmospheric pressure, said adjustment comprising venting said void space whenever $P_2$ is greater than atmospheric pressure;

e. removing the resulting cured shaped sand mass from said chamber, and separating the cured sand shell from the uncured internal portions of the shaped sand mass.

2. The method of claim 1 in which $P_1$ is sub-atmospheric and $P_2$ is atmospheric.

3. The method of claim 1 in which said $P_1$ and $P_2$ are sub-atmospheric pressures and in which air is introduced into the shaped sand mass thereafter through the portion thereof resting on said pallet to provide said adjustment of pressure to atmospheric pressure.

4. The method of claim 1 in which said $P_2$ is super-atmospheric pressure, and in which the void space is vented to provide the adjustment of the pressure within the chamber to atmospheric pressure.

5. The method of claim 1 in which said binder is a furan-type liquid binder and in which said gas catalyst is a gaseous acidic catalyst.

6. The method of claim 1 in which said binder is a silicate type binder, and in which said gaseous catalyst is carbon dioxide.

7. The method of claim 1 in which said binder is an iso-cure type binder, and in which said gaseous catalyst is an amine.

8. The method of manufacturing shell cores and molds comprising the steps:

a. charging a sand mix to a pattern, said mix comprising sand having a uniform coating of binder dispersed thereon, said binder comprising a gas curable binder, said pattern having a sand receiving portion including a shaped surface, and an opening through which the sand is charged to said pattern, said sand being charged into said pattern in sufficient quantity to provide a charged sand mass which fills the pattern to said opening;

b. providing a gas barrier at said opening of the pattern which barrier cuts off communication of the interstitial spaces in the charged sand mass in the area of said opening with any other gas space;

c. inverting said pattern and charged sand mass over a sand mass-supporting surface, separating the pattern from the sand mass to provide a shaped sand mass the exposed surface of which conforms to the shape of said pattern shaping surface;

d. enclosing said shaped sand mass within a gassing chamber and positioning said shaped sand mass therein to provide a void space between the shaped surface of said sand mass and the walls of said gassing chamber, and sealing said gassing chamber with respect to communication of gas therein with the atmosphere;

e. providing an initial pressure $P_1$ of inert gas within said chamber;

f. charging a gas catalyst to the chamber through said void space until the pressure in the chamber is $P_2$, the difference between $P_1$ and $P_2$ being such that the extent of penetration of the catalyst into the shaped sand mass is limited to provide a cured sand shell at the shaped surface thereof of desired thickness the remaining internal portions of the shaped sand mass remaining uncured;

g. when said $P_2$ is above or below atmospheric pressure providing an adjustment of pressure within said gassing chamber by introducing an inert gas into said interstitial spaces when $P_2$ is below atmospheric pressure, and by venting said void space when $P_2$ is above atmospheric pressure;

h. removing the resulting shaped sand mass from said gassing chamber and separating the cured shaped shell from the remaining uncured internal portion of the sand mass.

9. The method of claim 8 in which said binder is a furan-type binder, and in which said gas catalyst is a gaseous acidic catalyst.

10. The method of claim 8 in which said binder is a silicate type binder, and in which said gaseous catalyst is carbon dioxide.

11. The method of claim 8 in which said binder is an iso-cure type binder, and in which said gaseous catalyst is an amine.

12. The method of manufacturing shell cores or molds comprising the steps:

a. positioning a shaped sand mass in a gas chamber, said sand mass comprising sand having a uniform coating of binder dispersed thereon, said binder comprising a gas curable binder, said sand mass having external surfaces thereof, some of said external surfaces constituting the shaped portion thereof, and the other of said surfaces constituting the remaining surfaces, said sand mass being positioned within said gassing chamber to provide a void space between said shaped portion and the walls of said gassing chamber, said shaped portions being directly exposed to said void space, said remaining surfaces being provided with gas barriers which cut off direct communication of the interstitial spaces in the shaped sand mass with said void space;

b. providing an initial pressure $P_1$ of inert gas atmosphere within said gassing chamber;

c. introducing gas catalyst into said gassing chamber until post-gassing pressure $P_2$ is achieved, the difference between $P_1$ and $P_2$ being such that the extent of penetration of the catalyst into the shaped sand mass is limited, thereby curing a sand shell of desired thickness at the shaped portions of said shaped sand mass exposed to said void space the remaining portions of said sand mass remaining uncured;

d. When said post-gassing pressure $P_2$ is above or below atmospheric pressure, providing an adjustment in gas pressure within said gassing chamber to bring the pressure thereof to atmospheric pressure, said adjustment being achieved by introduction of inert gas into said interstitial spaces when said $P_2$ is below atmospheric pressure, said adjustment being achieved by venting said void space when said $P_2$ is above atmospheric pressure;

e. removing said shaped sand mass from said gassing chamber and separating the cured shell portion thereof from the remaining uncured portion thereof.

13. The method of claim 12 in which said shaped sand mass is confined within a flask, and is resting on a pallet when it is placed within said gassing chamber.

14. The method of claim 12 in which said binder is a furan-type binder, and in which said gas catalyst is a gaseous acidic catalyst.

15. The method of claim 12 in which said binder is a silicate type binder, and in which said gaseous catalyst is carbon dioxide.

16. The method of claim 12 in which said binder is an iso-cure type binder, and in which said gaseous catalyst is an amine.

* * * * *